US006425471B1

(12) United States Patent
Guindulain Vidondo

(10) Patent No.: US 6,425,471 B1
(45) Date of Patent: Jul. 30, 2002

(54) COIN SELECTOR

(75) Inventor: Félix Guindulain Vidondo, Navarra (ES)

(73) Assignee: Jofemar, S.A., Navarra (ES)

( * ) Notice: Subject to any disclaimer, the term of this patent is extended or adjusted under 35 U.S.C. 154(b) by 85 days.

(21) Appl. No.: 09/641,670

(22) Filed: Aug. 18, 2000

(30) Foreign Application Priority Data

Aug. 18, 1999 (ES) ..... 9901904

(51) Int. Cl.[7] ..... G07D 7/00

(52) U.S. Cl. ..... 194/203; 194/201; 194/317; 194/327; 194/339

(58) Field of Search ..... 194/201, 203, 194/327, 339, 317, 331

(56) References Cited

U.S. PATENT DOCUMENTS

| | | | | | |
|---|---|---|---|---|---|
| 2,306,531 | A | * | 12/1942 | Dowey et al. | 194/320 |
| 2,435,933 | A | * | 2/1948 | Toolan | 194/223 |
| 3,323,627 | A | * | 6/1967 | Nielsen | 194/329 |
| 3,483,958 | A | * | 12/1969 | Pennell et al. | 194/102 |
| 3,497,049 | A | * | 2/1970 | Erickson | 194/331 |
| 3,559,789 | A | * | 2/1971 | Hastie et al. | 194/331 |
| 3,586,146 | A | * | 6/1971 | Heirbaut et al. | 194/244 |
| 3,672,481 | A | * | 6/1972 | Hastie et al. | 194/323 |
| 3,682,286 | A | * | 8/1972 | Prumm | 194/317 |
| 3,910,394 | A | * | 10/1975 | Fujita | 194/331 |
| 4,000,800 | A | * | 1/1977 | Loucks, Sr. | 194/215 |
| 4,089,400 | A | * | 5/1978 | Gregory, Jr. | 194/329 |
| 4,298,116 | A | | 11/1981 | Kitten | D7/334 |
| 4,333,556 | A | * | 6/1982 | Robbins | 194/232 |
| 4,577,744 | A | | 3/1986 | Birmingham | D7/334 |
| 4,607,650 | A | * | 8/1986 | Kobayashi et al. | 221/13 |
| 4,681,204 | A | * | 7/1987 | Zimmermann | 194/317 |
| 4,806,744 | A | * | 2/1989 | Briane et al. | 235/449 |
| 4,881,630 | A | * | 11/1989 | Kobayashi et al. | 194/203 |
| 4,918,724 | A | * | 4/1990 | Vogl et al. | 194/203 |
| 5,226,520 | A | * | 7/1993 | Parker | 194/317 |
| 5,248,023 | A | | 9/1993 | Vidondo | 194/137 |
| 5,291,980 | A | * | 3/1994 | Abe | 194/214 |
| 5,316,118 | A | * | 5/1994 | Ibarrola et al. | 194/317 |
| 5,370,210 | A | * | 12/1994 | Ibarrola et al. | 194/317 |
| 5,476,168 | A | * | 12/1995 | Malzard et al. | 194/203 |
| 5,487,252 | A | * | 1/1996 | Ozeki et al. | 53/212 |
| 5,787,158 | A | * | 7/1998 | Anello et al. | 194/347 |
| 5,797,475 | A | * | 8/1998 | Bointon et al. | 194/137 |
| 5,833,042 | A | * | 11/1998 | Baitch et al. | 194/317 |
| 6,059,089 | A | | 5/2000 | Vidondo | 194/317 |
| 6,098,777 | A | * | 8/2000 | Hoffman et al. | 194/318 |
| 6,155,399 | A | * | 12/2000 | Bruner | 194/203 |
| 6,193,045 | B1 | * | 2/2001 | Ishida et al. | 194/203 |
| 6,223,877 | B1 | * | 5/2001 | McGinty et al. | 194/317 |

FOREIGN PATENT DOCUMENTS

| | | |
|---|---|---|
| EP | 184393 | 6/1986 |
| EP | 483451 | 5/1992 |
| EP | 499137 | 8/1992 |
| EP | 500836 | 9/1992 |
| EP | 543212 | 5/1993 |
| EP | 710935 | 5/1996 |
| FR | 2638266 | 4/1990 |
| GB | 2236609 | 4/1991 |
| GB | 2278946 | 12/1994 |
| WO | 9210814 | 6/1992 |
| WO | 9215075 | 9/1992 |
| WO | 9306569 | 4/1993 |

* cited by examiner

*Primary Examiner*—Joseph E. Valenza
*Assistant Examiner*—Jeffrey A Shapiro
(74) *Attorney, Agent, or Firm*—Klauber & Jackson

(57) ABSTRACT

Improved coin selector of the type being incorporated in any kind of machines operated by means of the insertion of coins to be validated, the selector (1) comprising an anti-thread safety mechanism constituted by a generally L-shaped lever (3) that is positioned in respect of the coin inlet opening (2), that is rotably mounted in respect of a shaft (4) by the end of one of its wings, while its other wing, in its resting position, crosses the coin passage channel (5) and interferes, by its free end, the beam of a pair of photodiodes (6), it being provided below the lever (3) with a feeler (7) of a general L-shape being rotable by its vertex, one of its wings (9) having a shape of a truncated cone that, in its resting position, crosses the coin passage channel (5).

5 Claims, 3 Drawing Sheets

FIG. 6
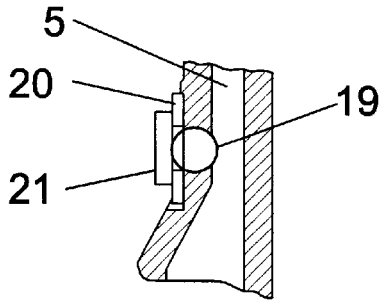
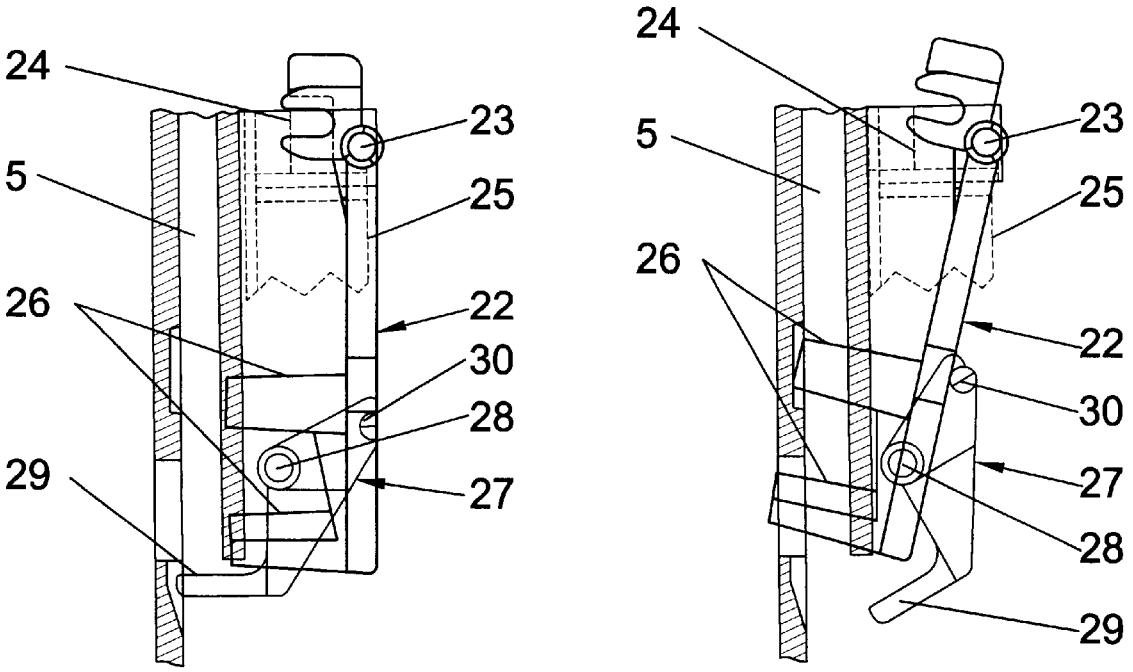
FIG. 7

COIN SELECTOR

OBJECT OF THE INVENTION

The following invention, as expressed by the title of the present description, consists of an improved coin selector being of the type of coin selectors which are mounted in any type of automatic machines and apparatus which operate by means of the insertion of coins such, that the improvements are addressed to the different mechanisms or devices that the selector incorporates as there are, the anti-thread safety mechanism, the activation of the electronic coin measuring and control system, the measurement of the different parameters of the coins to be validated and in the acceptance and access safety of the coins being validated as good.

In short, it deals with obtaining a coin selector of great reliability and that allows to avoid frauds, such that it detects and validates as good valid coins, discriminating the false ones, and that furthermore coins having been validated as good ones may not be recovered, once entered into the accounts, by the inlet in the case that they are attached to a thread, the anti-thread mechanisms acting deactivating the system and impeding the recovery of validated coins.

FIELD OF APPLICATION

The coin selector which is presented is of special application in automatic machines and apparatus which operate by the introduction of coins whereby the measuring and control system remains "dormant" while no coin validations are carried out, having a minimum energy consumption as the measuring and control system is only activated when detecting the presence of coins to be validated.

BACKGROUND OF THE INVENTION

As time passes, coin selectors have been evolving such that, at a beginning, the selectors basically referred to carrying out the reading of a series of parameters of coins for their validation, for which purpose there were opposed sensors performing the corresponding readings in the passage channel of the coins within the selector.

In this way, if the readings performed by the sensors were within a series of values already recorded in the selector itself, the coin was validated as good and if said values were not within the prerecorded intervals, the coin was validated as not being correct, and rejected.

Later, coin selectors evolved by incorporating different anti-thread safety mechanisms for avoiding that coins attached to threads could be inserted to activate the coin acceptance system and thereafter be extracted, with diverse results.

Thus, certain selectors, in the proximity to the coin inlet opening, incorporate a rotable lever which, by its free end, interferes the beam of a pair of diodes such, that when the coin is inserted, it produces the movement of said lever and, thus, the release of the beam so that, until the beam has not again been interfered, the system will not definitively accept the coin so that, when the coin is attached to a thread, this latter impedes the lever from returning to its initial position so that acceptance of the coin is not produced albeit it may have been validated as good.

On the other hand, upon the coins freely falling through the insertion opening, upon abutting against with the base of the passage conduct in front of the measuring sensors, there occur rebounds of the coins at their advance, which causes that the coins when facing the sensors, the relative position thereof is not always the same, whereby a dispersion of the measurements is produced, being it convenient to make the measurement with the coins being always in the same relative position in respect of the sensors.

We can also cite Utility Model U950755 in which there is described an anti-thread mechanism constituted by a lever being rotable in respect of a shaft, being positioned in relation to the access opening for the coins to the selector, said lever being provided with a prolongation which is fitted between a pair of projections of a second lever being also provided with a prolongation that is arranged between a pair of diodes, i.e. the anti-thread mechanism is configurated by two levers which are related to each other.

Also, in said file there is described a weight detector defined by a generally C-shaped plate which can be fixed by the free end of one of its wings whereas its other wing protrudes through a window of one of the walls of the coin passage conduct, said weight sensor remaining in a plane lower than that of the rolling and converging towards its free end, causing the coins when rolling, to fall impacting on its free end for reading the weight in view that the cited sensor is provided with a pair of gauges one of which is arranged at each side thereof.

DESCRIPTION OF THE INVENTION

In the present description, there are described improvements referring to coin selectors, so as to obtain a selector of greater reliability, both in the validation of coins as in the safety thereof against possible frauds, such that the improvements introduced into the selector comprise an anti-thread safety mechanism constituted by a lever of a general L-shape being positioned in respect to the coin inlet opening, that is mounted rotably in respect of a shaft by the end of one of its wings whilst its other wing crosses the coin passage channel when in a resting position, and interferes by its free end the beam of a pair of photodiodes, there being arranged below the lever, a feeler of a general L-shape being rotable about its vertex, one of the wings thereof having a shape of a truncated cone which, in its resting position, stays crossing the coin passage and which, on the possible impact of the coins, guides them towards the anvil, thereby waking up or activating the measuring and control system, from which dampening anvil onwards the coins homogeneously roll along a lever being rotable in respect of a shaft of its front end which lever is related with a weight measuring gauge, the coins being guided for their collection or return by means of a system of intercepting means constituted by a pair of interrelated levers.

The lever being rotable in respect of a shaft of its end preceding in respect of the advance of the coins, on which the coins remain for their validation, has a projection that crosses one of the walls of the coin passage channel and stays over the free end of a gauge which measures the weights of the coins on the grounds of the deformation transmitted thereto by the projection upon the coins rolling over the lever.

The system of intercepting means for guiding the coins for their collection or return, is constituted by a pair of levers and in such a way that the lever being positioned downstream in accordance with the advance movement of the coins, is mounted rotably in respect of a shaft being parallel to the channel of advance movement of the coins and, as well, said lever is attached to the end of the core of a coil, the lever having a pair of projections that, in their resting positions, remain crossing the coin passage channel such that the lever becomes related to the preceding lever by means of a projection against which it abuts.

The lever relative to the system of intercepting means guiding the coins for collection or return thereof, is mounted rotably in respect of a shaft being parallel to the channel of advance movement of the coins, it being provided more upwardly than said rotation shaft, with a projection on which the lever abuts, whilst lower than the rotation shaft, it has a base projection which in its resting position remains retracted in respect of the coin passage channel thereby leaving channel A free for the return of the coins.

Activation of the coil causes that, upon its core retracting, it provokes tilting of the lever, retracting the pair of projections in respect of the coin passage channel, whilst said tilting of the lever provokes tilting of the lever upon pushing in respect of the projection thereof, causing the thereto opposed projection to become positioned in respect of coin passage channel A closing it, so that the coins roll thereon to fall through collection channel B.

To complete the description which will be made hereafter, and so as to help to a better understanding of the characteristics of the invention, there is accompanied to the present description, a set of drawings in the figures of which the most characteristic details of the invention are represented in an illustrative, non-limiting way.

BRIEF DESCRIPTION OF THE DESIGNS

FIG. 1 shows a front view of the selector in which the essential mechanisms for its perfect operation in the validation of the coins as well as the anti-thread mechanisms are represented.

FIG. 2 shows two sectional views of the anti-thread mechanism mounted in the proximity of the coin inlet opening to the selector, whereby it may be observed that the same is defined by an L-lever which, by one of its ends crosses the passage channel interfering the beam of a pair of diodes, the same having been represented in a resting position interfering the beam and in the position retracted from the path of a coin.

FIG. 6 shows a sectional view of the coin passage channel whereby there may be observed, the impact toughness detector which is constituted by a ball being incrusted in one of the walls on which all coins impact, of the coin passage channel, and which incorporates a card and a piezoelectric sensor.

FIG. 7 shows two sectional views of the intercepting means for guiding the coins having been validated as good ones or having been rejected, conducted respectively to the final moneybox or to the returning devices, or otherwise to the return casing.

DESCRIPTION OF A PREFERRED EMBODIMENT

Figure 1:
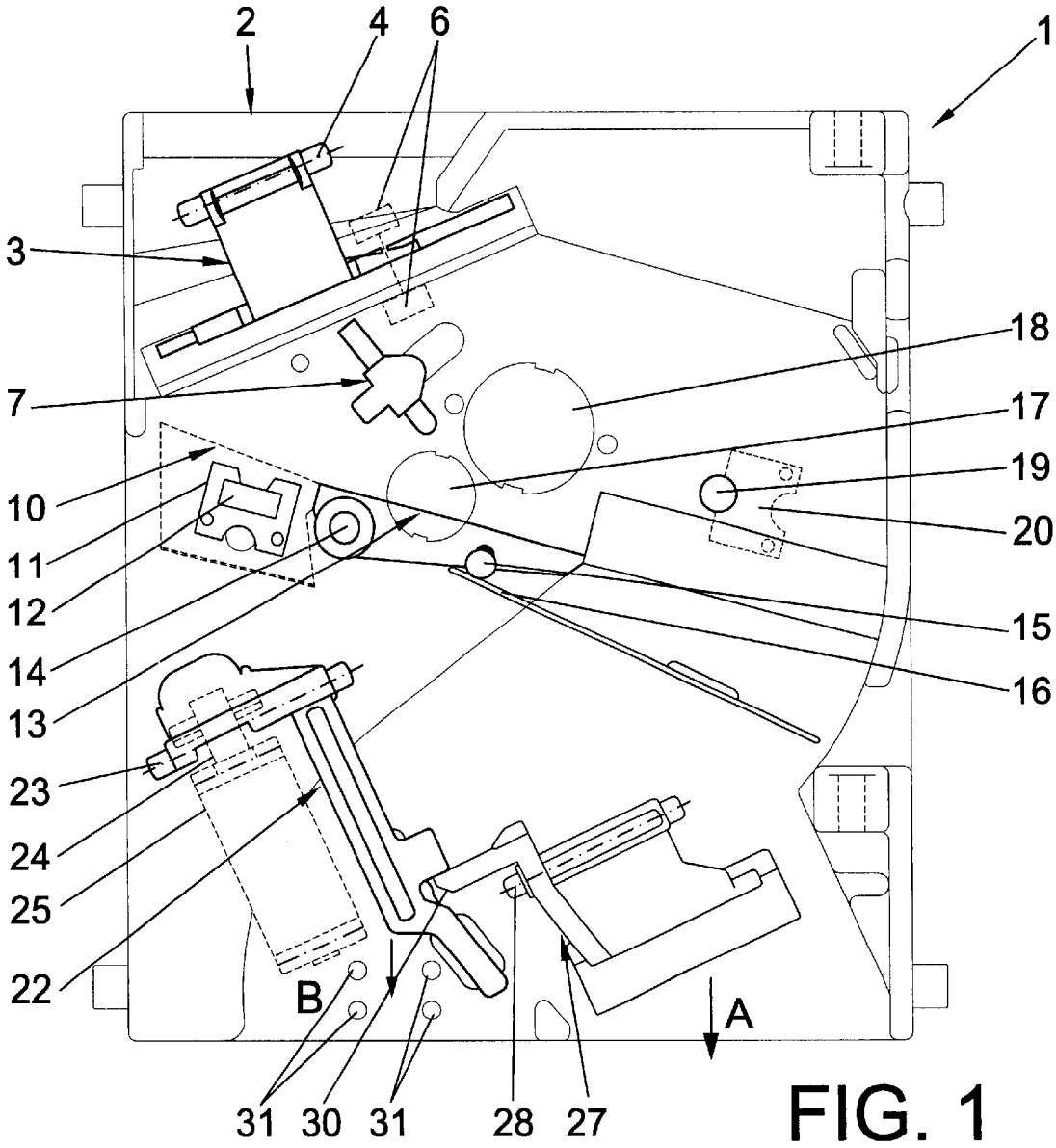
Figure 2:
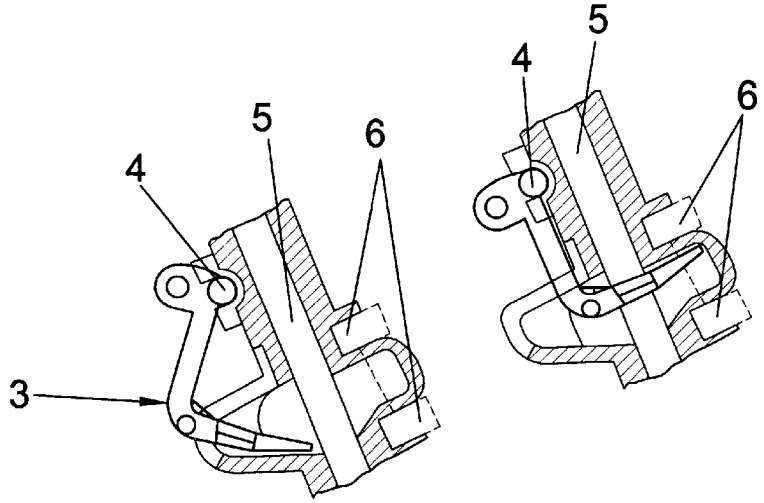
Figure 3:
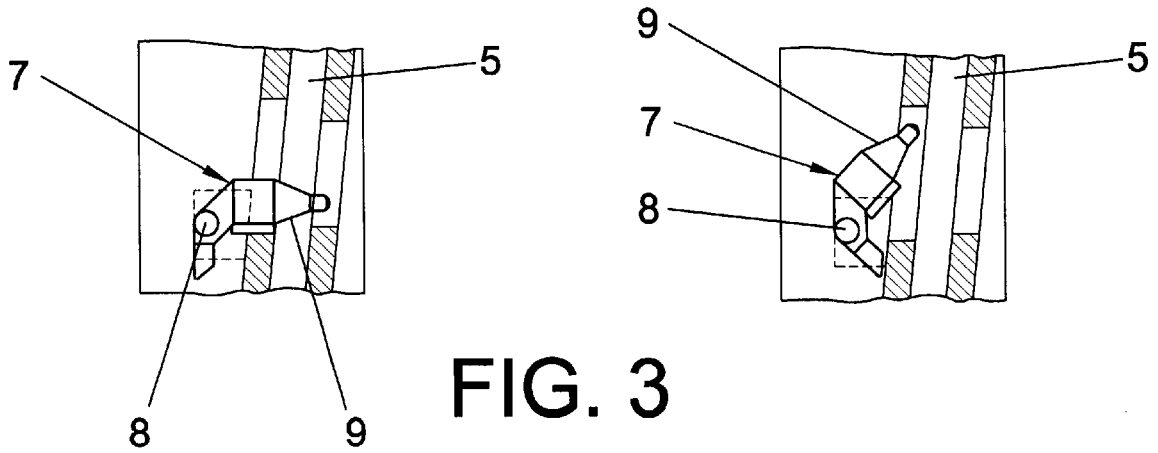
FIG. 3 shows two sectional views of the feeler that guides the coins towards the anvil that dampens their fall so that they commence to roll homogeneously, the feeler having been represented in its resting position in relation to the coin passage channel and in its position being retracted as a consequence of the impact of a coin.
Figure 4:
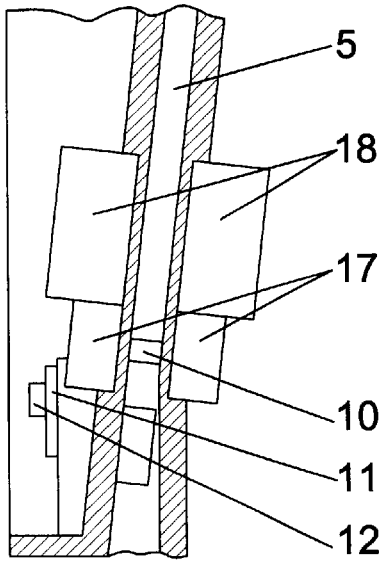
FIG. 4 shows a sectional view of the coin passage channel, whereby the activating mechanism of the measuring and control system that incorporates a card and piezoelectric sensor, can be observed.
Figure 5:
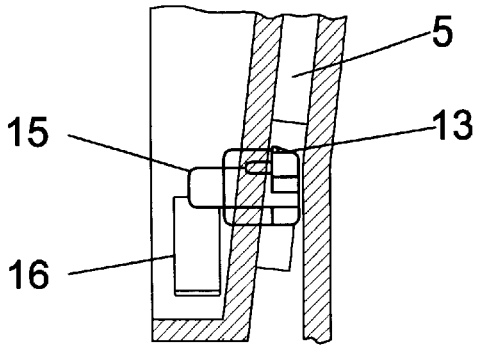
FIG. 5 shows a sectional view of the coin passage channel, whereby the coin weight measuring gauge related with a rotable lever on which the coins roll, can be observed.

In view of the commented figures and in accordance with the numeration as adopted, we can observe how the coin selector 1 arranges, in relation to the inlet opening 2 for the coins to be validated, a lever 3 being rotable in respect of the shaft 4, said shaft 3 having a general L-shape, said shaft 4 being provided with rotation with respect to the end of one of its wings, whilst the other wing stays crossing the coin passage channel 5 interfering by its free end with the emitter beam related to a pair of photodiodes 6.

Thus, when a coin is inserted by the opening 2 of the selector 1, upon impacting against the wing of the lever 3 crossing the coin inlet and passage channel 5, it retracts and the beam of the photodiodes 6 is released, so that when said lever 3 does not return to its original resting position within a predetermined period of time, this is to interfere the beam of the emitter related to the pair of photodiodes 6, the system is deactivated, acting as an anti-thread safety mechanism, as when the coin is attached to a thread, it is impeded that the lever 3 returns to its original position, so that the coin is not validated upon the measuring and control system becoming deactivated.

On the other hand, the coin selector 1 includes the feeler 7 constituted by a body of a general L-shape and rotable in respect of the shaft 8 which is positioned in the proximity of its vertex, the feeler 7 having by its wing 9 a shape of a truncated cone and, in its resting position, staying crossed with respect to the passage channel 5 for the coins to be validated, with the goal that all coins are to fall on the dampening anvil 10 for commencing, as from the same, a homogeneous rolling.

In this way, it is achieved that all coins, even those of minor diameter, always fall on the anvil 10 as, if they do not penetrate vertically into the selector they abut against the feeler 7 conducting them to the anvil 10. The feeler 7, on the impact with a coin, rotates with respect of its shaft 8, thereby retracting so as to allow the coin to pass, and returning to its original position by simple gravity.

In relation with the anvil 10 which dampens the fall of the coins to be validated, there is the device which "awakens or activates" the coin measuring and control system which is constituted by a card 11 and a piezoelectric sensor 12.

The coins introduced into the selector 1, once having impacted against the dampening anvil 10, homogeneously roll along the lever 13 being rotable in respect of shaft 14, facing the pairs of sensors 17 and 18 which detect the conductivity of the material of the coins and, as well, the lever 13 is interrelated with a gauge 16 by means of protrusion 15, such that the passing of coins over the rotable lever 13 makes the protrusion 15 cause a deformation in the gauge 16 with the object of detecting the weights of the coins. In this way, the coins roll along the lever 13 and the weight-detecting gauge 16 is positioned behind the wall of the passage channel, transmitting the movement to the gauge by means of the protrusion 15 which crosses said wall of the channel and contacts at the top with the deformable gauge 16 which is fixed by its other end.

Thereafter, the coins to be validated impact against a ball 19 incrusted in one of the walls of the passage channel, against which wall the coins are leaned on their rolling as the base of the rolling path has a slight inclination which makes that all coins roll being leaned against said wall so that all of them inexorably impact against said ball 19 with the object of detecting the hardness of the impact by means of a card 20 and a piezoelectric sensor 21.

The coins having been validated in this way, are guided for collection when having been validated as good, or for their return if they have been validated as "not valid", for which purpose the selector 1 has a system of intercepting means constituted by a pair of levers 22 and 27 being interrelated with each other.

Thus, in the resting position, lever 22 is rotable in respect of a shaft 23, and it has two projections 26 which stay crossing the coin passage channel 5, whilst lever 27 stays retracted in respect of the passage channel of the coins for return thereof leaving the channel free.

In this way, when the validated coin has been considered "not valid", it is returned, and the intercepting means system stays immobile leaving return channel A free whilst, when the coin has been considered as good, the control system of the selector 1 causes activation of the coil 25 retracting the core 24 thereof which produces rotation of the lever 22 with respect to the shaft 23 whereby the projections thereof retract in respect of coin passage channel 5 and, simultaneously, lever 22 upon its rotation acts on the projection 30 of lever 27, causing rotation thereof in respect of shaft 28 causing that the base 29 of said lever is moved towards coin passage channel A, closing the same so that the coins roll therethrough and fall through channel B for collection thereof.

In the path of the coins through channel B, the same become to face a series of pairs of photodiodes 31 which communicate to the control system that the coin has been validated as good and that collection has been made. Furthermore, the intercepting means systems constituted by the pair of lever 22 and 27, acts as a second anti-thread safety device due to that once the coin 22 has overcome lever 22, it cannot be recovered because of the projections 26 thereof being arranged in respect of the passage channel, upon said lever 22 having returned to its resting position.

What is claimed is:

1. Improved coin selector being of the type of selectors being included in all kinds of automatic machines and apparatus which are operated by insertion of coins, and which are validated for making the collection and the subsequent delivery of the product or service, characterized in that the selector (1) comprises an anti-thread mechanism constituted of a lever (3) of a general L-shape, positioned in respect of the coin inlet opening (2), which remains rotably mounted with respect to a shaft (4) by the end of one of its wings whilst its other wing, in a resting position, crosses the coin passage channel (5) and interferes by its free end the beam of a pair of photodiodes (6), having arranged below the lever (3), a feeler (7) of a general L-shape being rotable about its vertex, one of its wings (9) having a shape of a truncated cone which, in resting position, stays crossing the passage channel (5) of the coins, and which at the possible impact thereof guides them towards the anvil (10), waking-up or activating the measuring and control system, starting from which dampening anvil, the coins homogeneously roll over a lever (13) being rotable in respect of a shaft (14) of its front end, which lever (13) is related with a weight measuring gauge (16), the coins being conducted for their collection or return by means of a system of intercepting means constituted by a pair of interrelated levers (22) and (27).

2. Improved coin selector according to claim 1, characterized in that the lever (13) being rotable in respect of a shaft (14) of its end preceding in respect of the advance of the coins, on which the coins stay for their validation, it presents a protrusion (15) crossing one of the walls of the coins passage channel (5) and staying on the free end of a gauge (16) which measures the weights of the coins by the deformation being transmitted thereto by the protrusion (15) upon the rolling of the coins over the lever (13).

3. Improved coin selector according to claim 1, characterized in that the system of intercepting means for conducting the coins for their collection or return, is constituted by a pair of levers (22) and (27) such that the lever (22) being positioned downstream in accordance with the advance of the coins, is mounted rotably with respect to a shaft (23) parallel to the channel for advance of the coins and, as well, said lever (22) is linked to the core (24) of a coil (25), the lever (22) having a pair of projections (26) which, in a resting position, stay crossing the coin passage channel such that the lever (22) remains related to the lever (27) being positioned precedingly thereto, by means of a projection (30) against which it abuts.

4. Improved coin selector according to claim 1, characterized in that the lever (27) relating to the system of intercepting means for conducting the coins for collection or return thereof, is mounted rotably in respect of a shaft (28) being parallel to the channel for advance of the coins, above said rotation shaft (28) there being arranged a projection (30) on which the lever (22) abuts, whilst below to the rotation shaft (28) it has a base projection (29) which, in its resting position, is retracted in respect of the coin passage channel, leaving the channel A free for return of the coins.

5. Improved coin selector according to claim 1 characterized in that activation of coil (25) makes that, upon its core (24) retracting, it causes tilting of the lever (22) retracting the pair of projections (26) in respect of the coin passage channel, whilst said tilting of the lever (22) causes tilting of lever (27) upon pushing in respect of the projection (30) thereof, causing that the thereto opposed projection (29) becomes positioned in respect of channel A of the coin passage, closing it so that the coins roll thereon to fall through collection channel B.

* * * * *